US005258732A

United States Patent [19]

Marquardt

[11] Patent Number: 5,258,732

[45] Date of Patent: Nov. 2, 1993

[54] OVERLOAD RELAY

[75] Inventor: Terry Marquardt, St. Charles, Ill.

[73] Assignee: Furnas Electric Co., Batavia, Ill.

[21] Appl. No.: 964,402

[22] Filed: Oct. 21, 1992

Related U.S. Application Data

[62] Division of Ser. No. 561,872, Aug. 2, 1990, Pat. No. 5,179,364.

[51] Int. Cl.[5] ..... H01H 73/12

[52] U.S. Cl. ..... 335/17; 335/132; 335/202

[58] Field of Search ..... 335/131-132, 335/202, 17

[56] References Cited

U.S. PATENT DOCUMENTS 4,254,316 3/1981 Landow ..... 335/132
4,301,342 11/1981 Castonguay et al. ..... 335/17
4,318,065 3/1982 Harbauer ..... 335/17

*Primary Examiner*—Lincoln Donovan

*Attorney, Agent, or Firm*—Wood, Phillips, VanSanten, Hoffman & Ertel

[57] ABSTRACT

An overload relay includes a base (22) with electrical contacts (162, 164) thereon. A lever (116) including a contact actuator (140) is in proximity to the contacts (162, 164) and a pivot (122) mounts the lever (116) on the base (22) for pivotal movement between first and second positions. A releasable latch (106) normally holds the lever (116) in a particular one of the positions and a spring (144) is interposed between the base (22) and the lever (116) at a location spaced from the pivot (122) to bias the lever (116) toward the other of the positions by applying a bias thereto in a generally predetermined direction. The direction and location are such that when the lever (116) is in a latched position, the bias will provide a relatively small force tending to move the lever (116) toward the unlatched position and further is such that as the lever (116) moves towards the first position, the bias produces an increasing force tending to move the lever (116) towards the unlatched position.

6 Claims, 4 Drawing Sheets

OVERLOAD RELAY

This is a division of application Ser. No. 561,872 filed Aug. 2, 1990, now U.S. Pat. No. 5,179,364.

FIELD OF THE INVENTION

This invention relates to a solid state overload relay, and more particularly, to the mechanical or electromechanical construction thereof.

BACKGROUND OF THE INVENTION

Overload relays have long been used in connection with heavy duty electrical machinery driven as, for example, three phase motors. Overload relays are more than simple circuit "interrupters"—they are sensors which, upon determining the existence of an overload or other undesirable circuit condition, break a circuit and in turn provide a control or an indicating function. Because they are typically employed with relatively expensive machinery, it is necessary that they be reliable in operation. As is well-known, reliability is a function of the number of components employed and thus it is highly desirable that the overload relay be of simple construction to achieve enhanced reliability.

At the same time, cost is always of concern. Thus, simplicity is not only desired from the standpoint of improving reliability, it is desired from the standpoint of reducing the cost of the overload relay as well.

It is also desirable that the overload relay be of relatively small size so that it may be easily and conveniently installed in any of a large variety of desired locations with respect to any given piece of machinery.

The present invention is directed to providing an overload relay, and particularly, the mechanical construction thereof, that meets one or more of the above objectives.

SUMMARY OF THE INVENTION

It is the principal object of the invention to provide a new and improved overload relay. More specifically, it is an object of the invention to provide a new and improved mechanical construction for such a relay.

An exemplary embodiment of the invention achieving the foregoing objects has a number of facets.

According to one facet of the invention, the overload relay includes a base and electrical contacts having a first conductive state wherein the contacts are closed and a second conductive state wherein the contacts are open. The contacts are located on the base. A lever is provided and includes a contact actuator in proximity to the contacts and a pivot mounts the lever on the base for pivotal movement between a first position wherein the contact actuator places the contacts in one of the conductive states and a second position wherein the contact actuator causes the contacts to assume the other of the conductive states. Releasable latch means are provided for normally holding the lever in the second position and a biasing means is interposed between the base and the lever at a location spaced from the pivot for biasing the lever towards the first position by applying a bias thereto in a generally predetermined direction. The direction of the bias and the location of the biasing means is so chosen that when the lever is in the second position, the bias will produce a relatively small force tending to move the lever toward the first position and further such that as the lever moves toward the first position, the bias produces an increasing force tending to move the lever toward the first position.

In a preferred embodiment, the biasing means is a compression spring and the lever is elongated. The direction is at an acute angle to the direction of elongation of the lever and slightly spaced from the pivot.

Preferably, the spring is a coil spring and is in a generally cylindrical configuration when the lever is in the second position.

The invention contemplates that the releasable latch means include a movable escapement latch for holding the actuator lever in the second position and a solenoid actuator for the escapement latch operable to cause the escapement latch to release the lever.

In a preferred embodiment of the invention, a movable trip indicator is provided and is movable between a normal position and a tripped position. The lever includes a retaining surface engageable with a trip indicator such that when the actuator lever is in the second position, it is operable to retain the trip indicator in its normal position. According to another facet of the invention, there is provided a base with electrical contacts as before. An actuating lever is movably mounted on the base for movement toward and way from a position engaging the contacts to change the conducting state thereof and an escapement lever is pivoted on the base. The escapement lever has a latch at one end engageable with the actuating lever to hold the same away from the contact engaging position and a solenoid is mounted on the base and has an armature connected to an end of the escapement lever opposite the one end and operable to move the escapement lever to move the latch out of engagement with the actuator lever. An enlarged mass is located on the escapement lever one end to at least partially offset the mass of the solenoid armature to provide a measure of dynamic balance to thereby prevent movement of the latch out of engagement with the actuator lever as a result of shock or vibration.

Preferably, the escapement lever includes a sleeve or boss intermediate its ends and a pivot pin extends through the sleeve to the base to pivot the escapement lever to the base. The mass is preferably integrally formed on one end and includes a notch for releasably receiving the actuating lever. According to still another facet of the invention, there is provided an overload relay which includes a base, an escapement lever pivoted intermediate its ends to the base, a solenoid mounted on the base and having an armature connected to one end of the escapement lever, and a retaining formation on the other end of the escapement lever. An actuating lever having a first end releasably engageable with the retaining formation is provided and has an opposite end pivotally connected to the base. A convex actuating surface is located intermediate the ends of the actuating lever. Stationery, spaced contacts are mounted on the base and an elongated, movable bridging contact is likewise mounted on the base. A spring is employed to bias the bridging contact with respect to the spaced contacts and a U-shaped actuator is slidably mounted on the base and has spaced legs engageable with the bridging contact at locations adjacent a corresponding one of the stationery contacts. The U-shaped actuator also has a bight extending between the legs and adjacent to the convex actuator surface to be engaged thereby. Means are provided for biasing the actuating lever such that the convex actuator surface will engage the bight with sufficient force to cause the actuator to move the bridging contacts against the bias of the spring and relative to the stationery contacts when the escapement lever releases the actuating lever.

In a highly preferred embodiment, the biasing means includes a compression coil spring having an axis with a first end abutting the base and a second end abutting the actuating lever between the ends thereof such that the axis is at an acute angle of less than about forty five degrees to the actuating lever and the spring first end is more remote from the actuating lever first end than the spring opposite end.

The invention also contemplates that there be a housing containing the base along with a trip indicator mounted in the housing for movement between a normal position and a tripped position. The actuating lever includes a latch for holding the trip indicator in the normal position when the actuating lever is engaged by the escapement lever.

In one embodiment, the housing for the relay includes a recessed opening and the escapement lever has an end exterior of the housing and within the recessed opening.

According to still another facet of the invention, the relay includes a housing having spaced walls defining an access opening and at least one conductor channel for receipt of an electrical conductor. A circuit breaking module including a base is mounted within the housing and includes electrical contacts and a resettable circuit breaking mechanism for operating the contacts. A closure is provided for the access opening and complementary formations are located on the housing adjacent one side of the opening and one side of the closure for establishing a releasable hinge means whereby the closure may be pivoted relative to the housing to position closing the access opening. At least one resilient finger is located on the closure and is directed toward the housing and positioned to move in a path into the opening when the closure is moved toward the same. A ridge is formed in the housing within the path of movement of the finger and the ridge includes a ramp located to be engaged by the finger and constructed to cam the finger along the ridge. A detent surface is adjacent the ramp for receiving and detaining the finger after the ramp has cammed the finger and as the closure closes the opening.

In a highly preferred embodiment, there are two of the fingers in spaced relation on the closure and two of the ridges in spaced relation within the housing.

Preferably, the closure includes at least one conductor opening aligned with the conductor channel.

In one embodiment of the invention, the ramp is made up of two intersecting, diagonal surfaces and is located on the side of the detent surface remote from the complementary formations defining the hinge means.

According to another facet of the invention, there is included a housing, a circuit breaking module and mechanism and a closure as before. An indicator opening is also provided in the housing and a trip indicator is mounted in the indicator opening for movement between a generally withdrawn, normal position and an exposed, tripped position. The trip indicator is elongated and has an intermediate section of reduced cross section. An arm including a recess complementary to the intermediate section is received thereon and the arm includes a latch extending to the mechanism to be restrained thereby when the contacts have not been operated and to be released when the mechanism operates the contacts. A spring is utilized to bias the trip indicator towards the tripped position.

In a highly preferred embodiment, the recess is in one end of the arm and the latch is formed on the other end thereof. Preferably, the recess is snap fitted about the intermediate section of the trip indicator.

According to a highly preferred embodiment of the invention, an end of the trip indicator within the housing is movable with the trip indicator between the above mentioned positions thereof and is engageable with the module when moving toward the normal position to reset the mechanism.

Preferably, the latch is a hook and the circuit breaking mechanism includes a movable contact operating lever and there is a recess on the lever which is alignable with the hook to receive the same to hold the trip indicator in the normal position.

According to a further facet of the invention, there is a housing, a circuit breaking module and a closure as before. Mating formations are located on the closure and the housing for holding the closure in a position closing the access opening and an elongated slot is located in the base closely adjacent and generally parallel to an edge thereof. A protuberance is located on the edge intermediate the ends of the slot to be in interference relation with one of the housing in the closure such that when the closure is in the position closing the access opening, a portion of the base between the slot and the edge is resiliently deformed to provide a biasing force to firmly locate and position the base within the housing.

According to this facet of the invention, the housing preferably includes interior, spaced rails and the base is nested between the rails. The edge containing the slot is generally transverse to the rails.

In one embodiment of the invention, the protuberance is located to engage the closure and preferably, to engage the closure adjacent the complementary formations defining the hinge means.

According to still another facet of the invention, there is provided a housing which has an interior, at least one conductor channel, exterior electrical terminals, and an opening. A circuit breaker module is located within the housing and includes a base mounting electrical contacts connected to the terminals and a circuit breaker mechanism including a movable element operable to effect relative movement between at least some of the electrical contacts. An extension is provided on the base and protrudes from the housing through the opening. The extension includes an actuator channel extending to the movable element. A subsidiary housing including interior movable contacts with exterior terminals connected thereto is provided and includes a movable contact actuator extending from a side thereof. Complementary formations on the extension and on the subsidiary housing are provided to couple the two together such that the actuator enters the actuator channel to be driven by the movable element.

In one embodiment, the contacts on the base are mechanically interposed between the actuator and the movable element. Preferably, the complementary formations are dovetail formations and in a highly preferred embodiment, there are aligned apertures in the extension and in the subsidiary housing for receipt of a threaded fastener to lock the dovetail formations together.

Other objects and advantages will become apparent from the following specification taken in connection with the accompanying drawings.

DESCRIPTION OF THE PREFERRED EMBODIMENT

Figure 1:
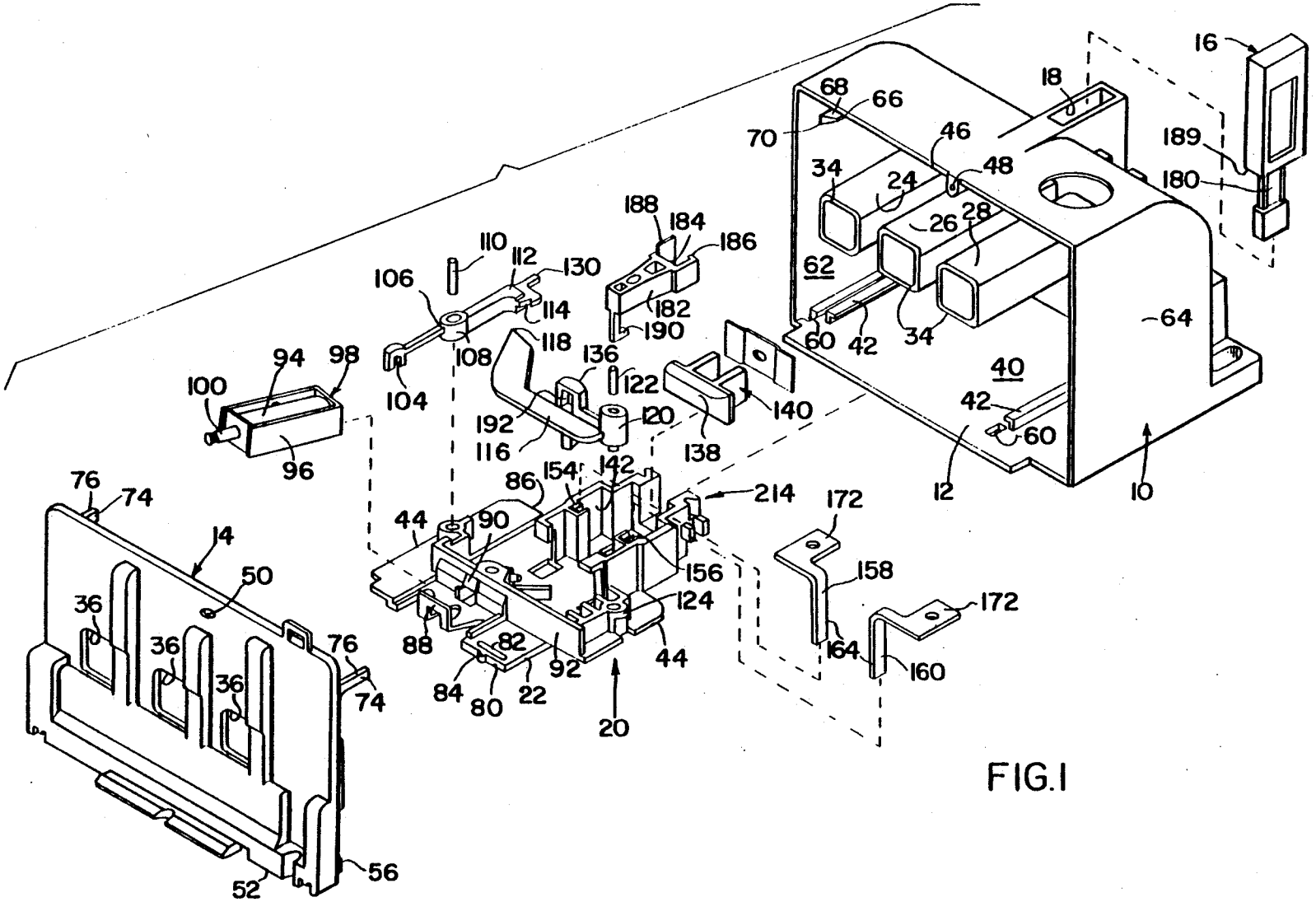
FIG. 1 is an exploded view of an overload relay made according to the invention.

An exemplary embodiment of an overload relay made according to the invention is illustrated in the drawings and will be described herein. It is to be understood that the invention is not restricted to any particular type of means for sensing the existence of an undesirable or overload condition, but rather, to means that are responsive to any such sensing device to operate electrical contacts in response thereto. In short, the sensing device can be any type of electrical or electronic means, solid state or otherwise. However, for reasons of space conservation and reliability, the use of solid state sensors and control circuitry would be preferred.

In any event, with reference to FIG. 1, the basic components of the system include a housing, generally designated 10, having an access opening 12 which is adapted to be closed by a removable closure, generally designated 14. A trip indicator and reset button, generally designated 16, is movably received in an opening 18 within the housing 10 and an overload relay module, generally designated 20, includes a base 22 which is slidably received within the housing 10.

Looking first at the housing 10, the same includes three tubular channels 24, 26 and 28 which are in side-by-side relation and which open through the front wall 30 (FIG. 7) of the housing 10 via openings 32, only two of which are shown. Ends 34 of the channels 24, 26 and 28 within the housing 10 are aligned with and extend to apertures 36 in the closure 34. Electrical conductors representing each phase of a three-phase circuit are simply passed through the channels 24, 26 and 28 and in the usual case, current transformers (not shown) will be associated with each of the channels 24, 26 and 28 to sense current flow through the associated conductor. This information is then sent to a sensing and determining circuit (not shown) which, as mentioned previously, may be of conventional construction and which then determines whether the overload relay should maintain its normal condition or whether the same should be tripped.

Located within the housing 10, and on a bottom wall 40 thereof, are parallel, spaced rails 42 that are of an inverted L-shape. The rails 42 are adapted to slidably receive opposed edges 44 of the base 22 of the module 20 and somewhat loosely locate the same within the housing 10.

An upper edge 46 of the access opening 12 includes an apertured tab 48 which is alignable with an opening 50 in the closure 14. A threaded fastener (not shown) may be utilized to secure the two together by introducing the fastener through the aperture 50 and the aperture within the tab 48.

Figure 6:
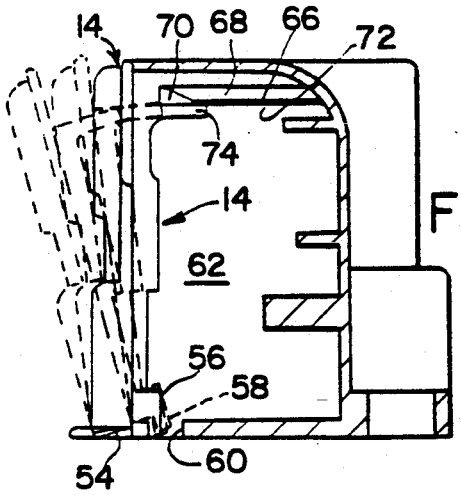
FIG. 6 is a sectional view illustrating assembly of a closure to the relay housing.

As best seen in FIGS. 1 and 6, the closure 14, near a bottom edge 52 thereof, includes spaced, L-shaped feet 56 having a relatively narrow, downward projections 58. As seen in both FIGS. 1 and 6, the housing 10, and specifically the bottom wall 40 thereof, include spaced apertures 60 for receipt of the downward projections 58 of each of the feet 60. Thus, the projections 58 and apertures 60 are complementary formations that define a hinge allowing the closure 14 to be pivoted at its lower edge 52 to the bottom wall 50 of the housing 10. The closure 14 may be moved through the dotted line positions shown in FIG. 6 towards a fully closed position by reason of the hinge like action provided.

Also as seen in FIGS. 1 and 6, opposed side walls 62 and 64 of the housing 10, on the interior thereof, are provided with inwardly directed ridges 66. The ridges 66 include an upper, diagonal surface 68 that merges into the side wall 62 or 64 at its upper edge along with an intersecting diagonal surface 70 which merges into the associated side wall 62 or 64 as one progresses towards the access opening 12. The underside or surface 72 of each of the ridges 66 is parallel to the bottom wall 40 of the housing 10 and acts as a detent surface.

Resilient fingers 74 are located on the closure and extend toward the interior of the housing 10. When the closure 14 is fitted to the housing 10 in the manner illustrated in FIG. 6, the upper surfaces 76 of the fingers may lodge under and in abutment with the detent surface on the associated ridges 66 to hold the closure 14 in a position closing the access opening 12. It can be appreciated from a consideration of FIG. 6 that as the closure 14 is moved towards a position fully closing the opening 12, the fingers 74 will be cammed along respective ridges 66 first by the diagonal surfaces 70 and then by the diagonal surfaces 68 which act as ramps. Once the fully closed position is attained, the fingers 74 snap under the ridges 66 and are held in place by the detent surfaces 72.

Figure 3:
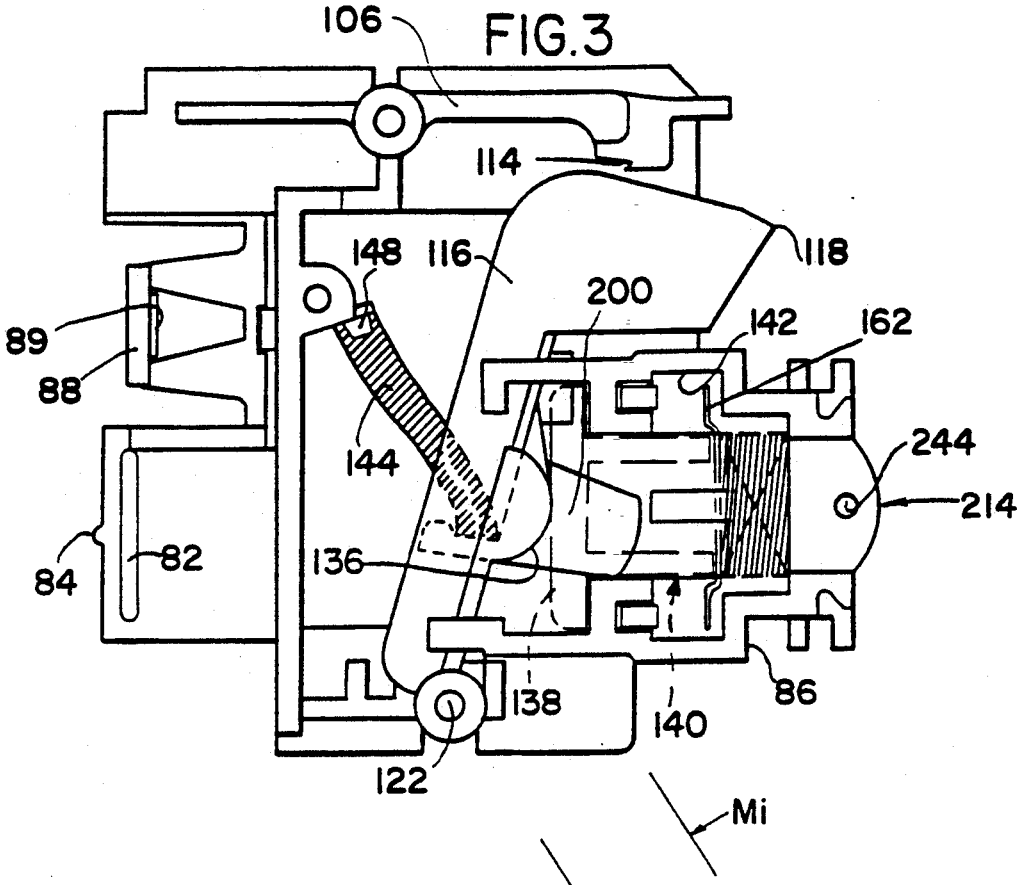
FIG. 3 is a view similar to FIG. 2, but showing the relationship of the components when the relay has been tripped.
Figure 2:
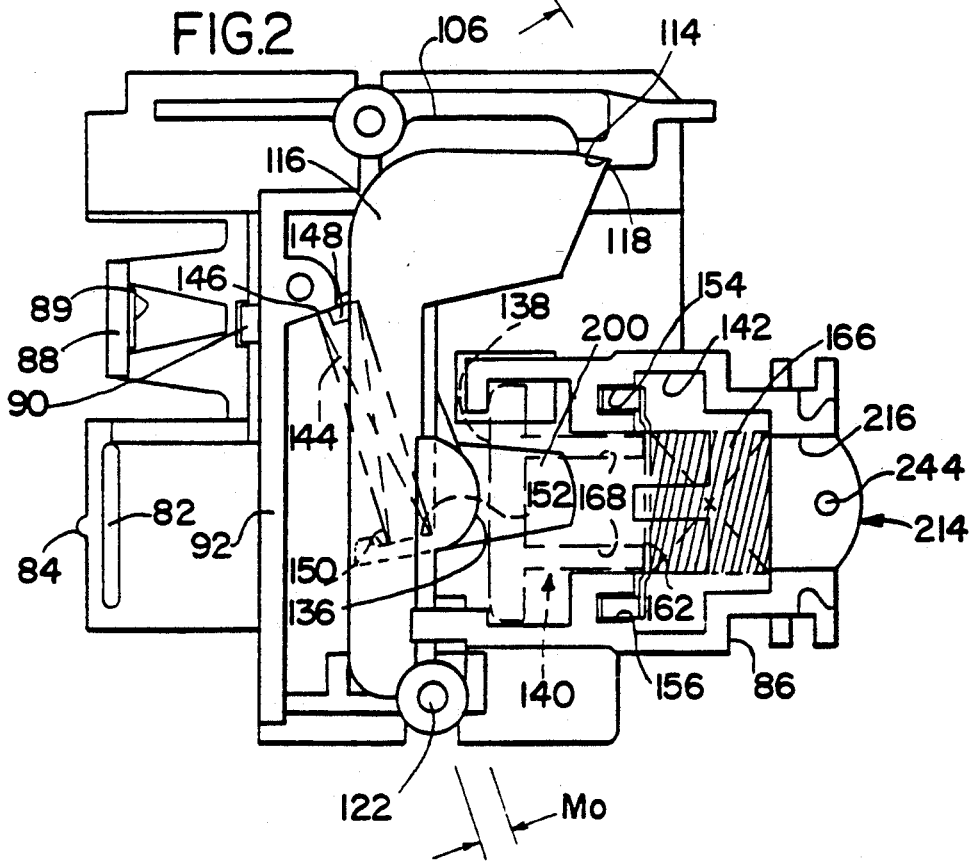
FIG. 2 is an enlarged, partial view of the relay in a normal or untripped condition.

Turning now to the module 20, the same include an edge 80 which generally extends between the edges 44 and is at a right angle thereto. As seen in FIGS. 1-3, an elongated slot 82 is located in close proximity to the edge 80 and a protuberance 84 is located on the edge 80 intermediate the ends of the elongated slot 82. The distance between the protuberance 84 and an opposite edge 86 of the base 22 of the module 20 is slightly greater than the interior dimension of the housing 10 with the closure 14 fully in place, which is to say that the protuberance 84 will be in interference relation with the housing components, specifically, the closure. As a consequence of this, closing of the closure will result in resilient deformation of that part of the base 20 between the protuberance 84 and the slot 82, which in turn provides biasing force to firmly locate and place and maintain the module 22 in the desired position between the rails 42.

Also adjacent the edge 80 is a somewhat resilient, upstanding tang 88 having a tooth 89 (FIGS. 2 and 3) directed towards a tooth 90 on a rigid partition 92 integral with the base 22. A solenoid 94 is mounted between the tang 88 and the tooth 90 such that the tooth 89 associated with the tang 88 and the tooth 90 overlie respective edges of a leg 96 of a U-shaped coil holder, generally designated 88 to mount the solenoid 94 to the base 22. (See FIGS. 2 and 3).

The solenoid 94 includes an armature 100 including a peripheral groove 102 which may be received in a recess 104 formed in one end of an escapement lever 106. The escapement lever 106 is pivoted to the base 22 by means of a sleeve or boss 108 intermediate the ends of the lever 106 and a pivot pin 110.

The end of the lever 106 opposite the recess 104 which receives the solenoid armature 100 is shown at 112 and is enlarged and so located with respect to the pivot pin 108 such that the moment of inertia of the end 112 approximates the combined moment of inertia of the end having the recess 104 and the moment of inertia of the armature 100. This provides a dynamic balance to the system including the solenoid armature 94 and the escapement lever 106 about the pivot pin 108 to prevent inadvertent tripping of the relay due to shock or vibration.

The end 112 includes a notch or latch 114 which is operative to engage and restrain an actuator lever 116 by engaging a pointed end 118 thereof. The actuating lever 118 has an integral sleeve or boss 120 at its opposite end and, by means of a pivot pin 122, is pivoted to an integral boss 124 on the base 22 adjacent a side edge 44 thereof.

Figure 7:
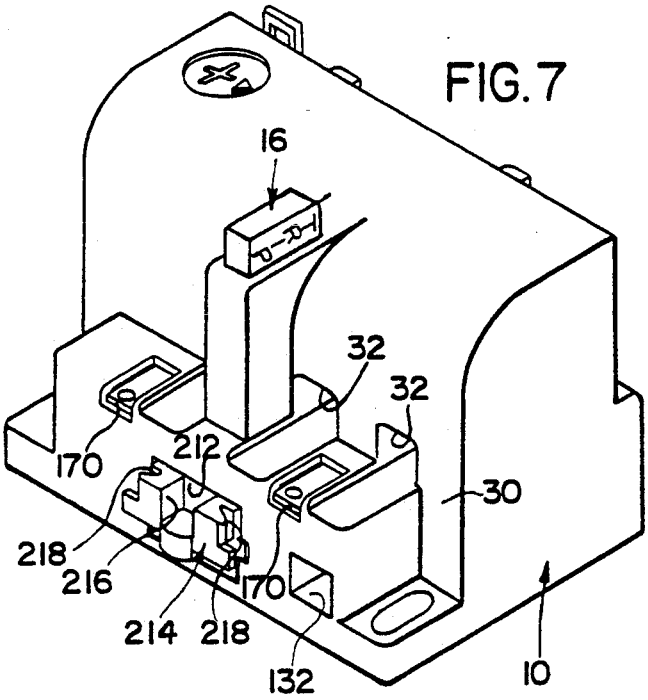
FIG. 7 is a perspective view of the assembled relay.

Returning briefly to the escapement lever 106, the end 112 includes an integral finger 130 which extends towards the front side 30 of the housing 10. As seen in FIG. 7, the front side 30 includes a recessed opening 132 and the finger 130 is aligned with the opening 132 to be received therein while not extending out of the same. Consequently, by utilizing an appropriate tool for insertion into the opening 132, the finger 130 may be engaged to pivot the lever 106 about the pivot axis defined by the pivot pin 110.

As seen in FIGS. 1-3, inclusive, intermediate the ends of the actuating lever 116 is a convex actuator surface 136. This surface may be cylindrical and is adapted to engage the bight 138 of a U-shaped actuator, generally designated 140. The actuator 140 is received in an upwardly opening cavity 142 on the base 22 whose shape is somewhat complementary to that of the actuator 138, but is sufficiently enlarged so as to allow the actuator 140 to move between the positions illustrated in FIGS. 2 and 3. The arrangement is further such that when the actuating lever 116 is latched by the escapement lever 106 with the pointed end 118 within the notch 114 as illustrated in FIG. 2, the convex surface 136 will be spaced slightly from the actuator 140 as viewed in FIG. 2. Conversely, if the escapement lever 106 is moved in a counterclockwise direction as viewed in FIGS. 2 or 3, the actuating lever 116 is released, and by means to be seen, will drive the actuator 140 from the position illustrated in FIG. 2 to the position illustrated in FIG. 3 by contact of the convex surface 136 with the bight 138.

The actuating lever 116 is driven from the position illustrated in FIG. 2 to that illustrated in FIG. 3 by a compression coil spring 144. When the actuating lever 116 is latched by the escapement lever 106, the spring 144 will be cylindrical as illustrated in FIG. 2 and will be in a compressed state. One end 146 is disposed about a small tooth 148 integral with the partition 92 while the other end 150 is received in a small recess 152 on the underside of the actuating lever 116 intermediate the ends of the latter. It will be immediately observed that the longitudinal axis of the spring 144 is at a small acute angle, always less than about 45°, to the axis of the lever 116 when the latter is latched As a consequence, when the actuating lever 116 is in the position illustrated in FIG. 2, the pressure exerted by the spring 114 against the same will tend to pivot it in a clockwise direction about the pivot axis defined by the pin 122 and the total force will be the spring pressure acting over a relatively small moment arm, $M_o$ as seen in FIG. 2. It will also be appreciated from a consideration of FIG. 3 in comparison to FIG. 2 that as the actuating lever 116 moves from the latched position towards the unlatched position illustrated in FIG. 3, the moment arm increases until the moment arm $M_i$ is reached and that the latter is several times greater than the original moment arm $M_o$. The same comparison will yield the information that the spring 144 has undergone an increase in length of perhaps less than 20 percent. This in turn means that when the actuating lever 116 is released by the escapement lever 106, the force moving the actuating lever 116 toward the position illustrated in FIG. 3 will actually be increasing as the movement occurs.

Considering FIGS. 1-3, for the moment, the cavity 142 includes spaced slots 154 and 158 for receipt of combination terminal/contact elements 158 and 160 respectively. A bridging contact 162 is located in the cavity 142 and is movable into electrical contact with the contact sections 164 of the terminal/contacts 156 and 160 to complete an electrical circuit between the two. A compression coil spring 166 is located in the cavity 142 and abuts the bridging contact 162 on the side thereof opposite the actuator 140 to bias the bridging contact 162 toward a closed position.

The actuator 140 is, as mentioned previously, U-shaped, and thus includes a pair of spaced legs 168 which abut the bridging contact 162 oppositely of the spring 166 and adjacent respective terminal/contacts 158 and 160. Consequently, when the actuating lever 116 is released by the escapement lever 106, the force of the spring 144 driving the actuating lever 116 will cause the convex surface 136 to abut the bight 138 of the actuator 140 and ultimately cause the legs 168 to move the bridging contact 162 out of contact with the contact sections 164 of the terminal/contacts 158 and 160 and break the circuit therebetween. This movement is, of course, against the bias of the spring 166. And because the movement causes compression of the spring 166, it will be appreciated that the biasing force applied to the bridging contact 162 increases as the latter is moved away from the terminal/contacts 158 and 160. Nonetheless, this movement is positive and reliable because of the unique arrangement described previously whereby the moment arm over which the pressure of the spring 144 acts is increased as the actuating lever 116 moves toward the position shown in FIG. 3. Stated another way, the increasing resistance of the spring 166 is more than offset by the increased force supplied by the spring 144 acting over an ever-increasing moment arm by reason of the unique geometry described previously.

Thus, for the configuration of the components illustrated, the solenoid 94 may be energized by an appropriate sensing circuit when an overload or other undesirable condition exists. The same will pivot the escapement lever 106 in a counterclockwise direction as viewed in FIGS. 1-3 and release the actuating lever 116 for movement in a clockwise direction about the pivot pin 122 under the bias of the spring 144. This will ultimately cause the bridging contacts 162 to move to an open position. That is to say, that in the configuration illustrated, the switching mechanism is a normally closed mechanism which will be opened when the device is tripped. Obviously, however, the contact sections 164 could be relocated on the opposite side of the bridging contact 162 if a normally open switching condition were preferred.

Turning to FIG. 7, it will be seen that the front side 30 of the housing 10 includes a pair of spaced openings 170. These openings 170 are adapted to receive the terminal sections 172 of the terminal/contacts 158 and 160 to permit external connections of control circuits thereto. Needless to say, the terminal sections 172 will receive screws (not shown) to allow secure fastening of electrical conductors thereto.

Figure 4:
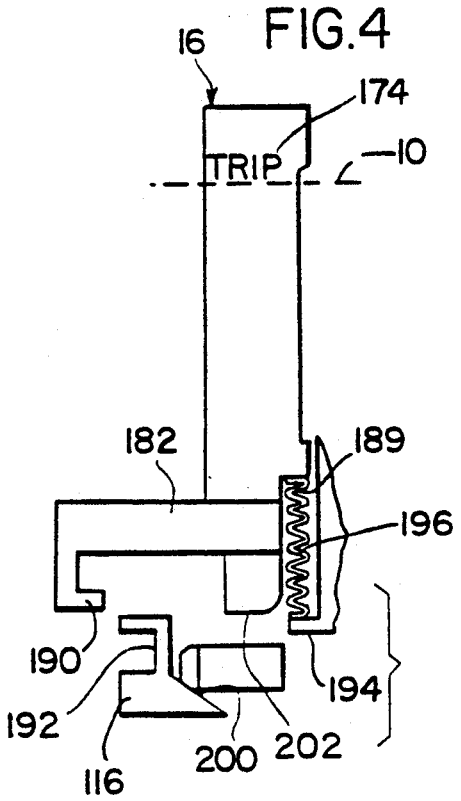
FIG. 4 is a fragmentary view of certain of the components after the relay has been tripped.

As seen in FIG. 7, the trip indicator 16 is in a tripped or extended position with respect to the opening 118 in the housing 10. This position is somewhat schematically illustrated in FIG. 4 wherein the top of the housing 10 is shown in a dotted line. If desired, indicia 174 may be located on the trip indicator 16 to indicate a trip when such has occurred. The indicia 174 will be located so as to be hidden within the housing 10 when there has been no trip.

As seen in FIG. 1, the trip indicator has an intermediate section 180 of reduced cross section. A latch arm 182 includes a recess 184 on one end thereof which is provided with a small hook, 186. This allows the recess 184 to be snap fitted about the intermediate section 180 of the trip indicator 116. A positioning finger 188 on one side of the recess 184 may engage the underside of an edge 189 on the trip indicator 16 to properly locate the arm 182 between the ends of the trip indicator 16.

The arm 182, at the end opposite the recess 184, includes a re-entrant hook 190, which may be received in a recess 192 formed on the actuating arm 116 intermediate its ends and oppositely of the convex surface 136.

Near the bottom of the opening 18 within the housing 10 is a small ledge 194 and a compression coil spring 196 is located on the ledge 194 and abuts the underside of the edge 189. Thus, the same provides an upward bias of the trip indicator 116 from a position like that illustrated in FIG. 5 to that shown in FIG. 4.

The arrangement of the recess 192 with respect to the hook 190 is such that the latter may be received in the former when the actuating arm 116 is in the latched position illustrated in FIG. 2, which corresponds to an untripped position of the relay. This position is shown approximately, but not exactly, in FIG. 5. Thus, the recess 192 serves to restrain upward movement of the trip indicator 16 when the actuating lever 116 is latched. Conversely, when the actuating lever 116 is released to move to the position of FIG. 3, the recess 192 no longer engages the hook 190 and the trip indicator 116 is free to move upwardly under the bias of the spring 196 and indicate a trip at the same time the bridging contacts 162 are being moved to the right as viewed in FIGS. 2 and 3.

Figure 5:
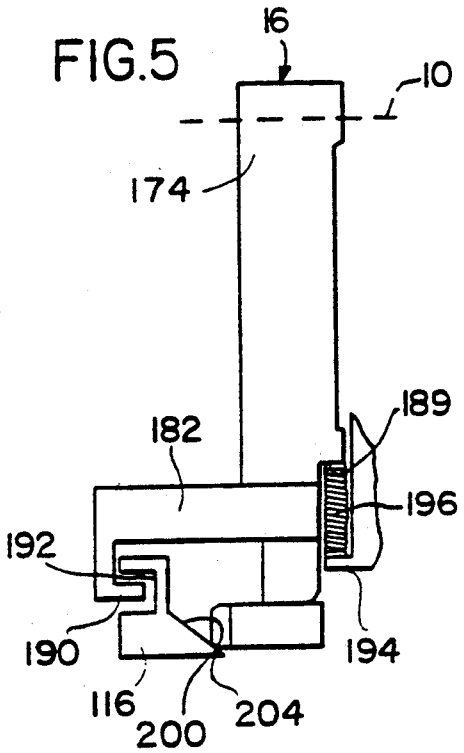
FIG. 5 is a view similar to FIG. 4, but illustrating the relationship of the components as the relay is reset.

Also formed on the actuating lever 116, below the convex surface 136 and located so as to extend below the actuator 140, is a segment of a frusto-conical surface 200. After the relay has been tripped and the components illustrate the position illustrated in FIG. 4, the same may be reset by exerting a downward force on the trip indicator 16 against the bias of the spring 196. The lower end 202 of the trip indicator 116 will engage the upper surface of the bight 138 of the actuator 140 and push the same down within the cavity 142. This will bring the bight 138, which may be advantageously bevelled as at 204 at least on its lower surface, into engagement with the frusto-conical surface 200 on the actuating lever 116 and the resulting camming action will cause the lever 116 to pivot in a counter-clockwise direction as viewed in FIGS. 1-3 until the pointed end 118 again is received and latched by the latch 114. This same movement will result in the hook 190 descending so as to be once again captured in the recess 192 as the lever 116 is pivoted. The full extent of resetting movement is illustrated in FIG. 5 and upon release of the trip indicator 116, a small amount of upward movement of the latter will occur until the hook 190 engages the upper surface of the recess 192.

Figure 9:
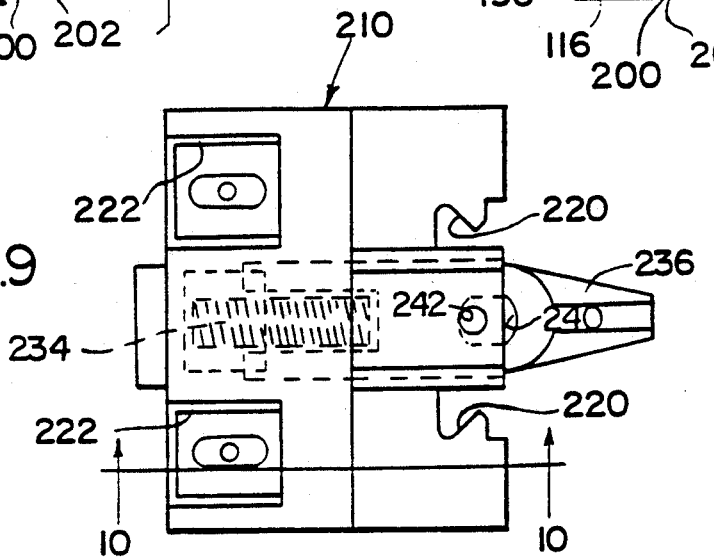
FIG. 9 is a plan view of a subsidiary housing containing auxiliary contacts.
Figure 8:
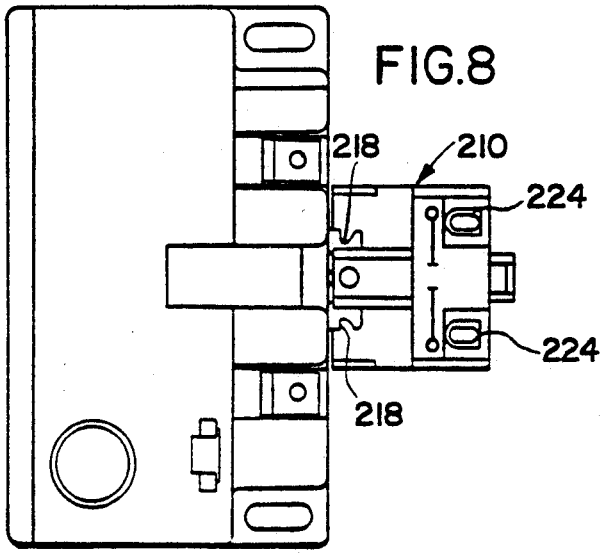
FIG. 8 is a plan view of the assembled relay with a set of subsidiary or auxiliary contacts mounted thereto.

In some instances, it is desirable to add a separate indicator or control circuit to the relay that is completely independent of the switch provided by the bridging contact 162 and the contact sections 164 of the terminal/contacts 158 and 160. To this end, a subsidiary housing containing additional switch contacts may be employed Such an auxiliary housing is generally designated 210 in FIG. 8. Referring to FIG. 7, the switch contacts may be employed Such an auxiliary housing is generally designated 210 in FIG. 8. Referring to FIG. 7, the front 30 of the housing 10 includes still another opening 212. As seen in FIGS. 1-3 and 7, the base 22 of the module 20 includes, on the side opposite the edge 80, an extension, generally designated 214. This extension 214 is sized to extend out of the front 30 of the housing 10 through the opening 212 and include an upwardly opening, interior, actuating channel 216 that extends all the way through the spring 166 for purposes to be seen. Dovetail formation 218 are located on the extension 214 on both sides of the channel 156 and as can be seen in FIG. 9, the subsidiary housing includes complementary dovetail formations 220 on a side thereof. As a consequence of this construction, the subsidiary housing 210 may be aligned with the extension 214 and the dovetail formations 218 and 220 aligned to mount the subsidiary housing 210 to the housing 10.

The housing 210 includes pockets 222 in which are received terminals 224 having threaded fasteners 226. The terminals 224 extend into a cavity 228 within the subsidiary housing 210 to provide contacts 230 therein. A movable bridging contact 332 is located within the cavity 228 and may be biased by two springs 234 (only one of which is shown) towards the contacts 230.

Figure 10:
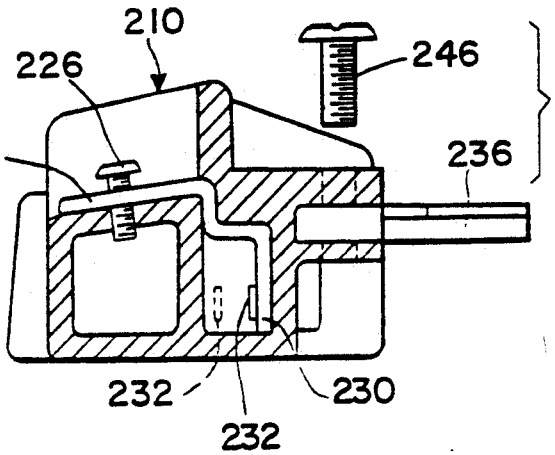
FIG. 10 is a vertical section taken approximately along the line 10—10 in FIG. 9.

An actuating arm 236 is slidably mounted within the subsidiary housing 210 and operatively associated with the bridging contact 232 so that when the arm 236 is moved to the left as viewed in FIGS. 9 and 10, the bridging contact 232 will be moved from the solid line position illustrated in FIG. 10 to the dotted line position thereof.

Preferably, the actuating arm 236 includes a slot 240 that is elongated in the direction of elongation of the arm 236 and which is aligned with an opening 242 in the subsidiary housing 210. The opening 242 may be aligned with an opening 244 in the extension 214 (FIG. 3) to receive a threaded fastener 246. Thus, once the subsidiary housing 210 is mounted to the housing 10 by means of the dovetail formations 218 and 220 being interengaged, the same may be locked together by application of the threaded fastener 246 without interfering with movement of the actuating arm 236. Because the actuating channel 216 is open at its upper end, the actuating arm 236 may readily enter the same as the dovetail formations 218 and 220 are engaged. The arm 236 is chosen to have a length sufficient to extend through the center of the spring 116 into engagement with the bridging contact 162 when the latter is in the position illustrated in FIG. 2. Consequently, when the relay is tripped, movement of the bridging contact 162 to the right as viewed in FIGS. 2 and 3 will move the actuator arm 236 into the subsidiary housing 210 to change the condition of the switch contacts therein. While the described embodiment illustrates the switch within the subsidiary housing 210 as being of the normally closed variety, the same may be a normally open switch if desired.

From the foregoing, it will be appreciated that an overload relay made according to the invention has numerous advantages. The unique construction of the spring 144 and its relation to the actuating arm 116 and the pivot point 122 therefore to provide increasing force even as the spring 144 extends provides for positive movement of the contact 162, even in the face of increasing resistance by compression of the spring 166 and the spring 234 if the subsidiary housing 210 is utilized.

The complementary dovetail formations 218 and 220 allow the addition of a separate wholly independent circuit by means of the subsidiary housing 210 if desired. The unique construction of the slot 82 as a means for providing firm mounting of the module 20 within the housing 10 simplifies construction and thereby reduces cost.

I claim:

1. An overload relay comprising:

a base;

an escapement lever pivoted intermediate its ends to said base;

a solenoid mounted on said base and having an armature connected to one end of said escapement lever;

a retaining formation in the other end of said escapement lever;

an actuating lever having a first end releasably engageable with said retaining formation, on opposite end pivotally connected to said base, and a convex actuator surface intermediate its ends;

stationary, spaced contacts mounted in said base;

an elongated movable bridging contact mounted on said base;

a spring biasing said bridge contact with respect to said spaced contact;

a U-Shaped actuator slidably mounted in said base and having spaced legs engageable with said bridging contact at location adjacent a corresponding one of said stationary contacts and a bight extending between said legs and adjacent said convex actuator surface to be engaged thereby;

means biasing said actuating lever such that said convex actuator surface will engage said bight with sufficient force to cause said actuator to move said bridging contact against the bias of said spring and relative to stationary contractor when said escapement lever releases said actuating lever; and a housing containing said base; and a trip indicator mounted in said housing for movement between a normal position and a tripped position;

said actuating lever including a latch for holding said trip indicator in said normal position when said actuating lever is engaged by said escapement lever.

2. An overload relay comprising:

a housing having spaced walls defining a access opening and at least one conductor channel for receipt of an electrical conductor;

a circuit breaking module including a base mounted within said housing and including electrical contacts and a resettable circuit breaking mechanism for operating said contacts;

a closure for said access opening;

an indicator opening in said housing;

a trip indicator mounted in said indicator opening for movement between a generally withdrawn, normal position and an exposed, tripped position, said trip indicator being elongated and having a reduced cross section intermediate section;

an arm including a recess complementary to said intermediate section and received thereon, said arm including a latch extending to said mechanism to be restrained thereby when said contracts have not been operated and to be released when said mechanism operates said contacts; and a spring biasing said trip indicator toward said tripped position.

3. The overload relay of claim 2 wherein said recess is on one end of said arm and said latch is on the other end thereof.

4. The overload relay of claim 3 wherein said recess is snap fitted about said intermediate section.

5. The overload relay of claim 4 wherein an end of said trip indicator within said housing is movable toward and away form said module while moving between said position and is engageable therewith when moving toward said normal position to reset said mechanism.

6. The overload relay of claim 2 wherein said latch is a hook and said circuit breaking mechanism includes a movable lever and a recess on said lever and alignable with said hook to receive the same to hold said trip indicator in said normal position.

* * * * *